US006701536B2

(12) United States Patent
Paul et al.

(10) Patent No.: US 6,701,536 B2
(45) Date of Patent: Mar. 9, 2004

(54) PROTECTIVE MASK

(76) Inventors: Barry Rene Paul, 20 Old Church Lane, Kingsbury, London NW9 (GB); Lance Gordon Rake, 917 Illinois St., Lawrence, KS (US) 66044

( * ) Notice: Subject to any disclaimer, the term of this patent is extended or adjusted under 35 U.S.C. 154(b) by 0 days.

(21) Appl. No.: 10/123,518

(22) Filed: Apr. 17, 2002

(65) Prior Publication Data

US 2002/0157167 A1 Oct. 31, 2002

(30) Foreign Application Priority Data

Apr. 18, 2001 (GB) ..... 0109480

(51) Int. Cl.[7] ..... A42B 1/08
(52) U.S. Cl. ..... 2/424; 2/9
(58) Field of Search ..... 2/455, 410, 4, 2/424, 425, 9, 468, 171, 173, 206, 909, 918

(56) References Cited

U.S. PATENT DOCUMENTS

| | | | | | |
|---|---|---|---|---|---|
| 2,362,597 | A | * | 11/1944 | Vince | 2/9 |
| 2,686,912 | A | * | 8/1954 | Shipman | 2/9 |
| 2,761,144 | A | * | 9/1956 | Shipman | 2/9 |
| 4,689,836 | A | * | 9/1987 | Vitaloni | 2/424 |
| 5,129,108 | A | * | 7/1992 | Copeland et al. | 2/424 |
| 6,112,333 | A | * | 9/2000 | Mazzei | 2/410 |

* cited by examiner

*Primary Examiner*—Gary L. Welch
(74) *Attorney, Agent, or Firm*—Dennison, Schultz, Dougherty & MacDonald

(57) ABSTRACT

The fencing mask comprises a steel mesh or plastic face piece 10, for protecting the face of a wearer. A fabric bib 15, for protecting the neck of the wearer, is detachably secured to the mask by means of an elongate channel member 16 connected to the lower edge thereof and extending from one side of the mask to the other from positions adjacent the ears of the wearer and passing under the chin of the wearer when worn and a co-operating elongate bead provided on or adjacent the upper edge of the bib 15.

15 Claims, 7 Drawing Sheets

PROTECTIVE MASK

BACKGROUND OF THE INVENTION

The present invention relates to an improved protective mask, and in particular a fencing mask for protecting the head and neck of a wearer while fencing using epee, foil or sabres, although it could also be used to protect the head and neck of the wearer during other contact sports such as Kendo.

As shown in FIG. 1, a known fencing mask comprises a steel mesh face piece 1 for covering the face of a wearer, a further mesh top panel 2 extending over the top of the wearer's head and down either side thereof to cover the wearer's ears and a thick fabric neck covering member, usually known as a bib 3. An elastomeric band 4 connects the face piece 1, top panel 2 and bib 3 together. The mask is held to the wearer's head by means of a bendable tab 5 extending over the top of the wearer's head and an elastic head band 6 extending around the rear of the wearer's head. The bib 3 is usually fastened to the mask by means of stitching around the lower periphery of the band 4 and along the lower sides of the top panel 2 just below the wearer's ears. Rivets 7 are used to reinforce the attachment of the bib to the top portion 2. The bib 3 is normally formed integrally with the internal padding of the mask in the region of the chin of the wearer, with a result that the inside covering of the bib must perform different functions, to be soft on the skin and to be har wearing where it is in contact with the fencer's jacket.

In use, the bib may become damaged or badly soiled. Presently replacement of the bib requires the return of the mask to the manufacturer and involves the removal of the glue and/or stitching attaching the bib to the remainder of the mask and the removal of any rivets used before a new bib can be glued and/or stitched and riveted into place. As such, replacement of the bib is a costly and time consuming process. When used with sabres the bib must be conductive and it is very time consuming to attach the bib to the mask using traditional methods so that it remains conductive over the entire outer surface of the bib. Furthermore, it is not possible to simply remove the bib to allow it to be washed or to replace the bib due to the metallic outer conductive layer of the bib, where fitted, becoming worn or damaged.

SUMMARY OF THE INVENTION

It is an object of the invention to provide a replaceable bib that is easier to manufacture and can be easily replaced by the owner when worn out without requiring the mask to be returned to the manufacturer. It is a further object of the invention to provide a mask wherein the bib can be easily removed to allow the bib to be washed. It is a further object of the invention to provide improved conductivity between the bib and the body of the mask where the outer surface of the bib is required to be conductive, for example when fencing with sabres.

According to the present invention there is provided a mask for protecting the face and neck of a person while fencing, the mask comprising a mask body, including a face piece for protecting the face of the wearer, retaining means for retaining the mask on the head of a wearer and a neck covering member for protecting the neck of a wearer, the neck covering member being detachably securable to the mask body by means of co-operating interlocking or interconnecting members provided respectively on the neck covering member and on the mask body to permit replacement of the neck covering member. Preferably the interlocking or interconnecting members are such that, when the neck covering member is connected to the mask body, no gaps exist between the neck covering member and the mask body through which the blade of a sword might pass.

In a preferred embodiment the interlocking or interconnecting members comprise an elongate channel member, provided on one of the neck covering member or the mask body, and an elongate bead, provided on the other of the neck covering member or the mask body, the elongate bead being receivable in the channel member to retain the neck covering member on the mask body. Preferably the width of the open side of the channel member is less than the internal width of the channel member at a position spaced inwardly from said open side such that the elongate bead can be slid into and out of the channel member from an end thereof but the bead cannot be removed from the channel member in a direction normal to the longitudinal axis of the channel. Preferably the channel member comprises two opposed side portions defining a receiving channel having a substantially circular cross section, the outer ends of the side portions defining an open side of the receiving channel, the width of the open side being less than the diameter of the circle defined by the side portions.

Preferably the channel member is provided on the mask body and the elongate bead is provided on or adjacent an upper edge of the neck covering member. The neck covering member may be formed from a flexible fabric material and the elongate bead may be defined by an elongate rod enclosed in a sleeve formed along the upper edge of the neck covering member. Alternatively the elongate bead may comprise a moulded or extruded plastic section which may be attached to the upper edge of the neck covering member by means of stitching or adhesive.

The mask body may include a panel extending over the top and sides of the wearer's head and under the wearer's chin, the channel member being attached to a lower edge of the panel extending from one side of the mask to the other side from positions adjacent the ears of the wearer and passing beneath the chin of the wearer. The panel and the face piece may be formed from a metallic mesh or, alternatively, at least a portion of the face piece and/or the panel may be formed from a transparent polymeric material such as polycarbonate and the face piece may be formed integrally with the panel. Where at least a portion of the face piece and/or the panel is formed from a transparent polymeric material the channel member may be formed integrally therewith. The channel member may extend along the entire free edge of the panel, at least one gap or open section being provided in the channel member to allow the elongate bead of the neck covering to be enter or exit the channel member so that the neck covering can be replaced. The retaining means for retaining the mask on the head of a wearer may be mounted in the channel member such that the position of the retaining means on the mask can be adjusted by sliding the retaining means along the channel member. Preferably the retaining means comprises a pair of substantially rigid retaining members have a bead portion receivable in the channel member such that the retaining members can be mounted in opposite sides of the mask.

According to a further aspect of the present invention there is provided a mask for protecting the face and neck of a person while fencing, the mask comprising a mask body for protecting the face of a wearer and a neck covering member for protecting the neck of a wearer, the neck covering member being detachably securable to the mask body such that there is provided a continuous join along the interface between the neck covering member and the mask body.

BRIEF DESCRIPTION OF THE DRAWINGS

The present invention will be described further, by way of example, with reference to the accompanying drawings, in which.

DESCRIPTION OF THE PREFERRED EMBODIMENTS

Figure 2:
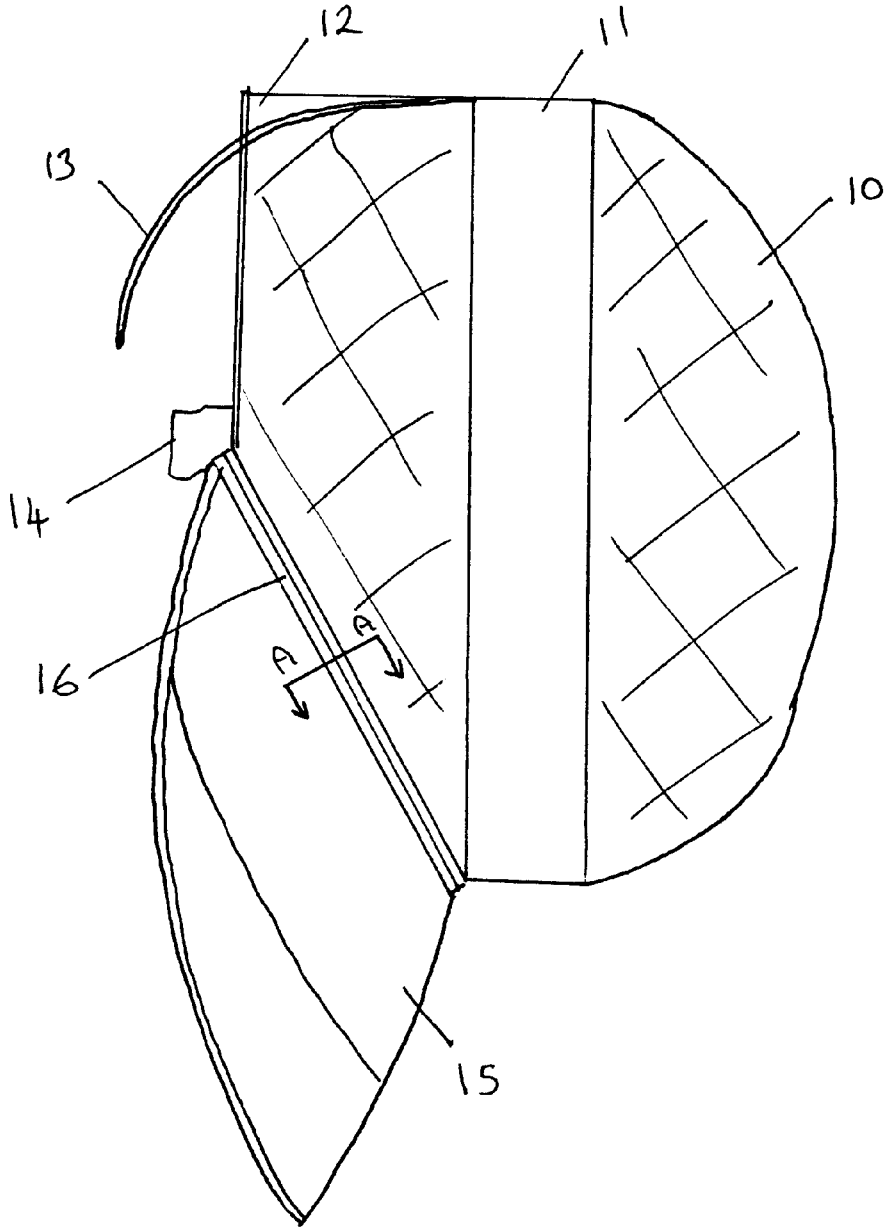
FIG. 2 is a side elevation of a fencing mask according to the invention.
Figure 3:
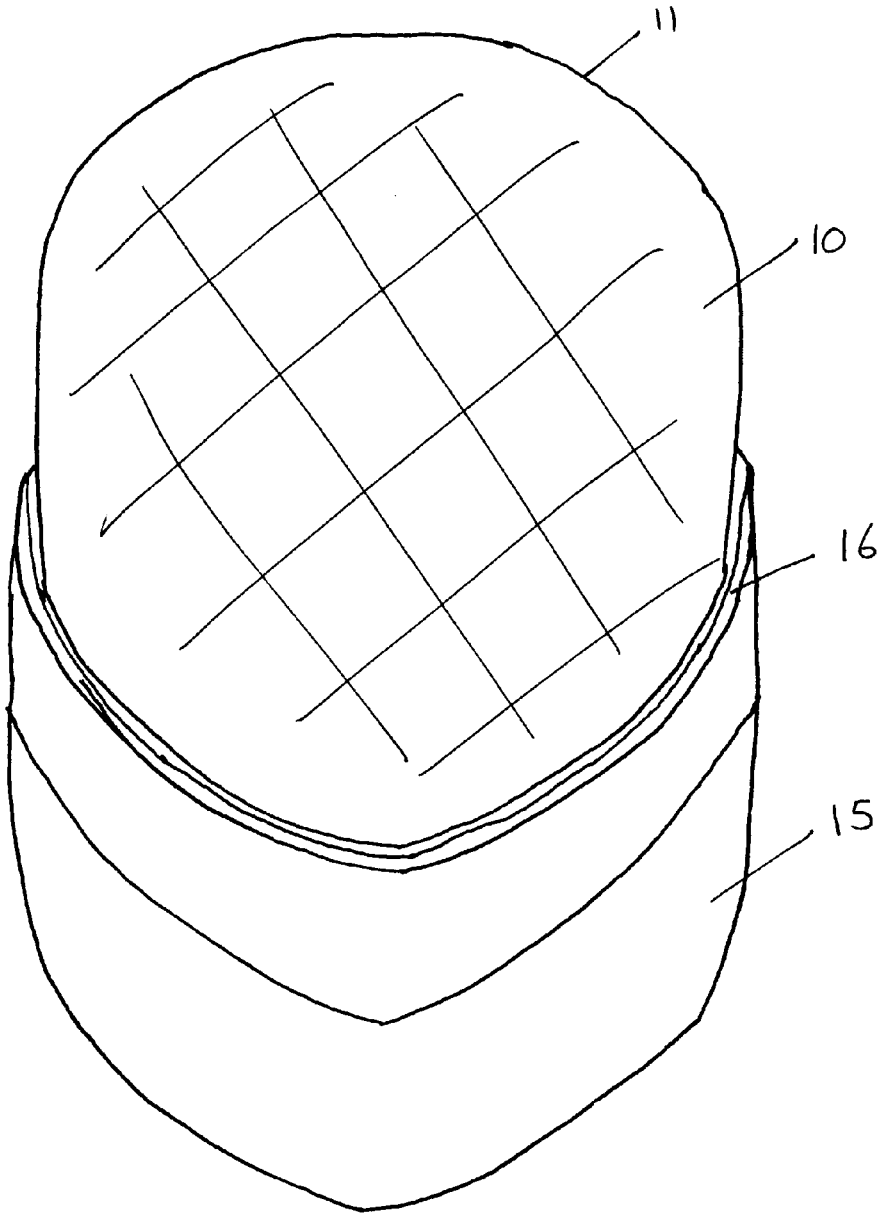
FIG. 3 is a front elevation of the fencing mask of FIG. 2.

A shown in FIGS. 2 and 3, the fencing mask comprises a steel mesh face piece 10, for protecting the face of a wearer, connected by stitching to a front side of an elastomeric band 11. A further mesh panel 12, extending over the top and sides of the wearers head and under the wearer's chin, is connected to the rear side of the band 11. Fastening means in the form of a bendable tab 13 and an elastic head band 14 are provided for holding the mask on the head of the wearer.

A fabric bib 15, for protecting the neck of the wearer, is detachably secured to the mesh panel 12 by means of an elongate channel member 16 connected to the lower edge of the mesh panel 12 and extending from one side of the mask to the other from positions adjacent the ears of the wearer and passing under the chin of the wearer when worn and a co-operating elongate bead provided on or adjacent the upper edge of the bib 15.

Figure 4:
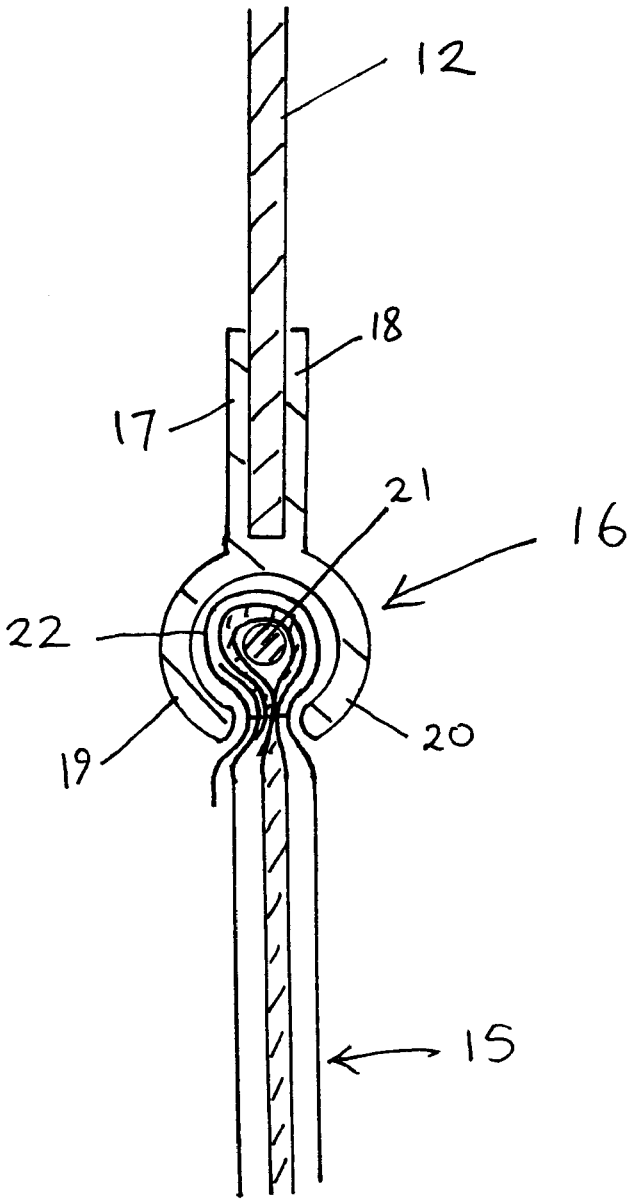
FIG. 4 is a partial sectional view on line A—A of FIG. 2.

As shown in FIG. 4, the channel member 16 comprises a pair of upwardly extending side portions 17,18 defining a channel in which is received the lower edge of the mesh panel 12. The edge of the mesh panel 12 may be secured in the channel by means of adhesive, stitching, rivets or welding. The bib receiving portion of the channel member 16 comprises two opposed downwardly extending side portions 19,20 defining a circular receiving channel, the lower ends of the side portions 19,20 defining an open side of the receiving channel, the width of the opening being less than the diameter of the circle defined by the side portions. The channel member 16 may be formed from an aluminium or plastic extrusion or moulding.

An elongate rod 21 is enclosed in a sleeve 22 formed along the upper edge of the fabric bib 15 to define the elongate bead which can be slid into the receiving channel of the channel member 16 from one end thereof to secure the bib 15 to the mesh panel 12. As such, no gaps remain between the bib 15 and the mesh panel 12 through which the blade or foil of a sword might enter. The elongate rod 21 may comprise a plastics material rod or a length of cord or string or a metal cable or wire. Alternatively, the bead may comprise a separate plastic moulding that is secured to the upper edge of the bib 15 by means of stitching and/or adhesive.

Figure 5:
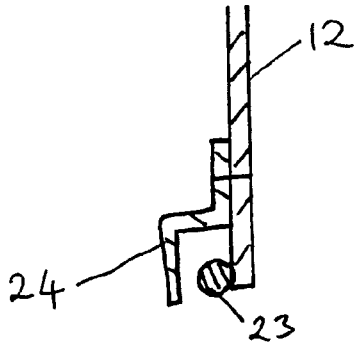
FIG. 5 is a partial sectional view of an alternative embodiment of the channel member.

FIG. 5. shows an alternative embodiment of the channel member 16. An elongate wire 23 is secured (for example by welding) to the lower edge of the mesh panel 12 and an elongate strip 24 is secured to the mesh panel 12 (again by welding) at a position adjacent the edge of the mesh panel 12 but spaced inwardly from the elongate wire 23, the elongate strip 24 being bent to define the base and one side of a U shaped channel, the lower edge of the mesh panel 12 defining the remaining side of the channel and the wire 23 defining a narrowed opening of the channel.

Figure 6:
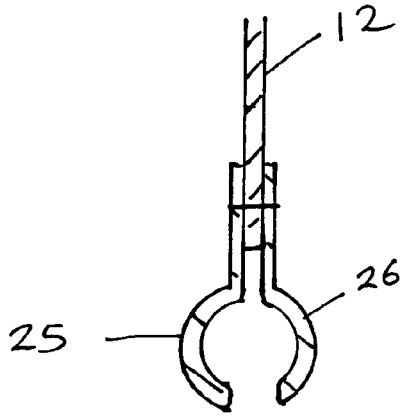
FIG. 6 is a partial sectional view of a further embodiment of the channel member.

FIG. 6 shows a further alternative embodiment of the channel member 16. The channel member 16 is defined by two elongate side portions 25,26, secured at their upper ends of opposite side of the lower edge of the mesh panel 12, for example by welding or adhesive. As with the embodiment shown in FIG. 4, each side portion 25,26 has a downwardly extending portion, the downwardly extending portions defining a circular receiving channel, the lower ends of the side portions 25,26 defining an opening of the receiving channel, the width of the opening being less than the diameter of the circle defined by the side portions 25,26.

Figure 7:
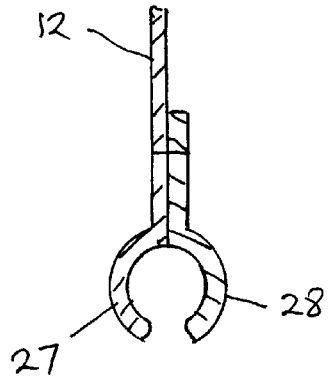
FIG. 7 is a partial sectional view of a yet further embodiment of the channel; member.

FIG. 7 shows a yet further alternative embodiment of the channel member 16. The channel member 16 is defined by two elongate side portions 27,28, a first side portion 27 comprising an extension of the mesh panel 12 or moulded equivalent portion, the lower end thereof being moulded to define one side of a circular receiving channel, a second side portion 28 being secured at its upper end to a portion of the lower edge of the mesh panel 12, for example by welding or adhesive, the lower end of the second side portion 28 defining a second side of the circular receiving channel.

Figure 8:
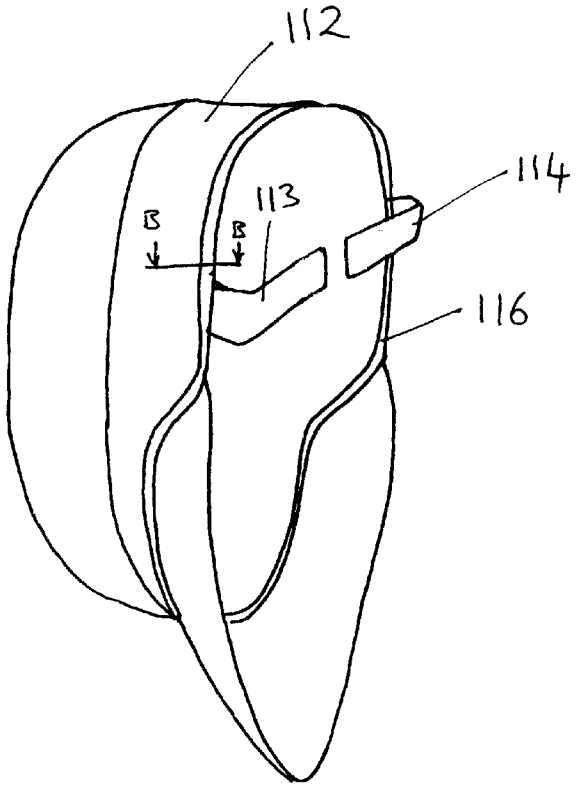
FIG. 8 is a perspective view of an alternative embodiment of the invention.

FIG. 8. shows an alternative embodiment of the invention wherein the channel member 116 extends along the entire free edge of the panel 112. In this embodiment the mask is retained on the wearers head by means of a pair of substantially rigid retaining members 113, 114 mounted in the channel member 116 on opposite sides of the mask.

Figure 9:
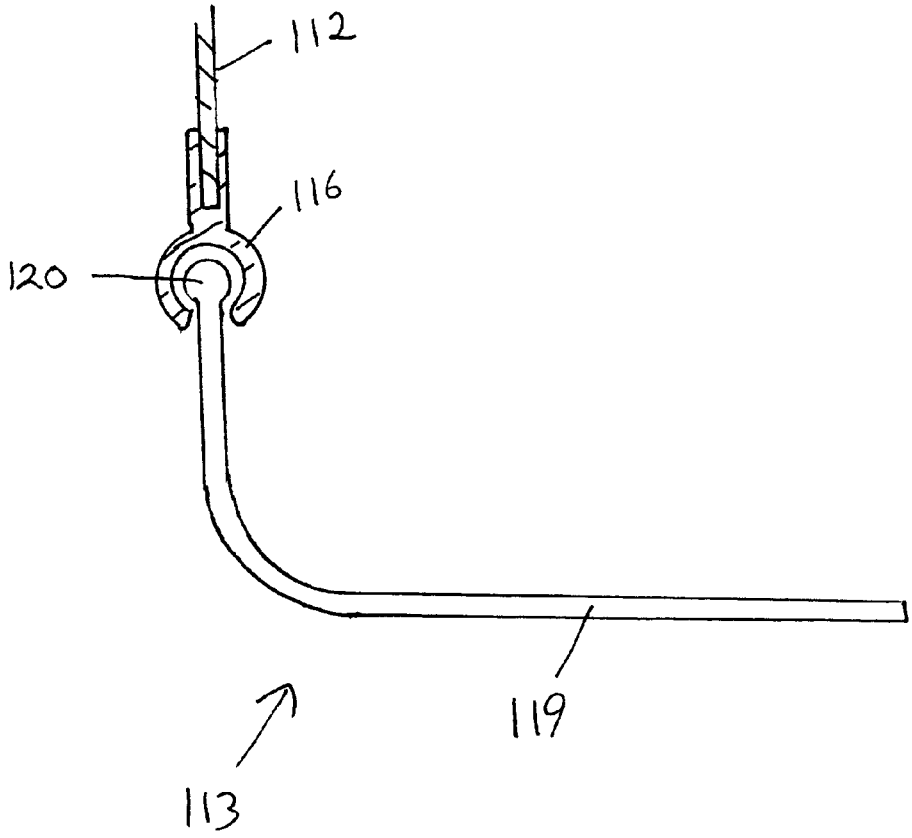
FIG. 9 is a sectional view on line B—B of FIG. 8.

As shown in FIG. 9, each retaining member 113–114 comprising a elongate substantially L shaped arm 119 having a bead portion 120 attached thereto or integrally formed therewith at an inner end thereof, the bead portion 120 being adapted to be received in the channel member 116. Each retaining member 113–114 is spring loaded to urge the arm 119 of each retaining member 113–114 towards the front of the mask in order to grip the wearer's head. By mounting the retaining members 113–114 in the channel member 116 the position of each retaining member 113–114 can be adjusted by sliding the bead portion 120 of each retaining member 113–114 along the channel member 16 to a desired position to suit the wearer. A gap or open section (not shown) is provided in the channel member 116 to allow the bib to be removed from and fitted to the channel member 116.

The fabric bib 15 may be made from a washable material, since it can be easily removed for washing. Since the bib is no longer part of the internal padding of the mask, as with the prior art masks with permanently attached bibs, the internal padding can be simplified and made removable without compromising the safety of the mask. Also the bib can be made completely from a waterproof fabric since it does not form part of the internal padding.

Since the bib is in contact with the mesh panel 12 along the full width of the channel member 16 conductivity over the full surface of the bib when used with sabres is ensured.

Figure 1:
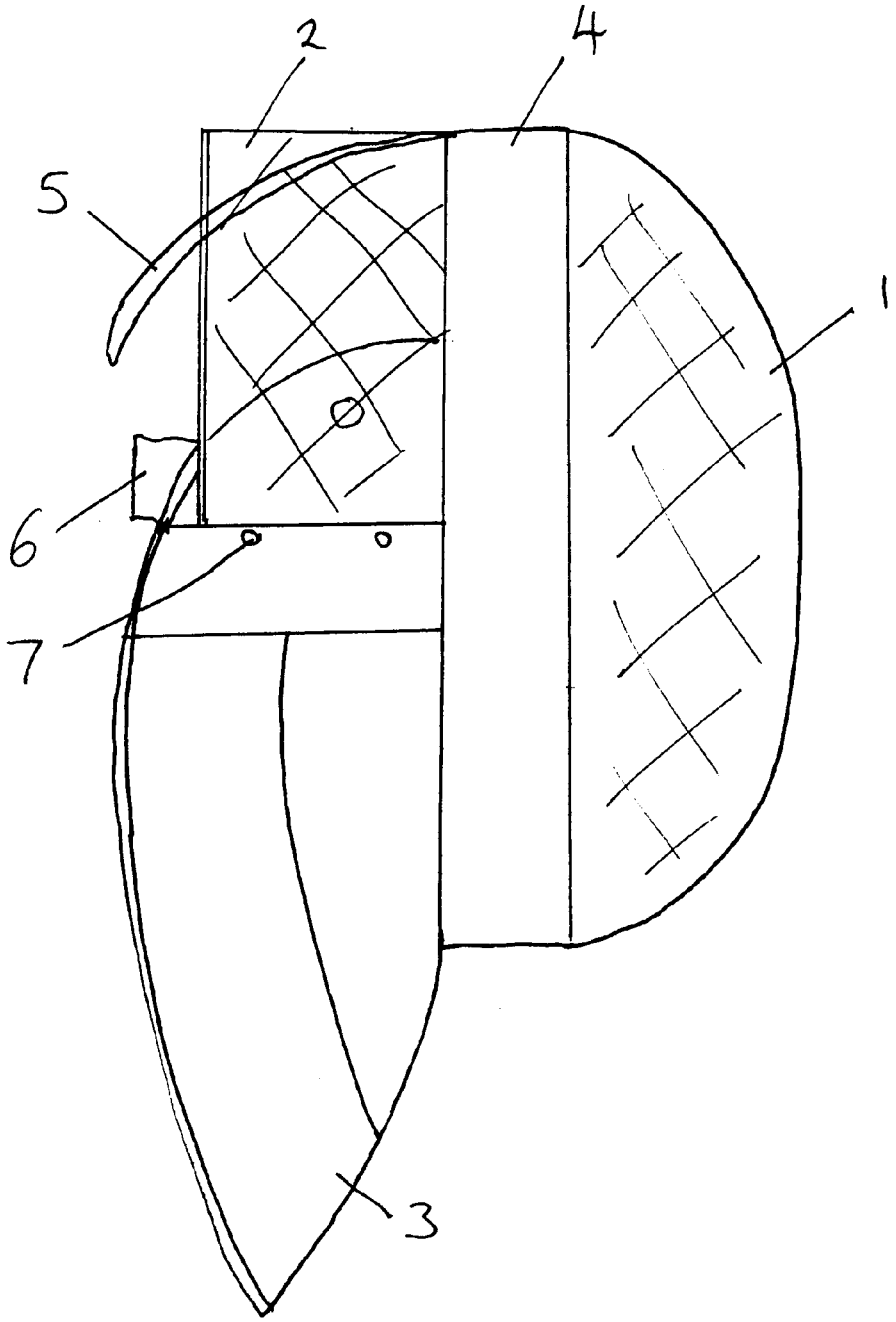
Fig. 1 PRIOR ART
FIG. 1 is a side elevation of a prior art fencing mask.

As can be seen from FIG. 2 in comparison with the prior art mask shown in FIG. 1, the mesh panel 12 extends much lower than that of the prior art, providing greater ventilation for the mask, allowing the wearer to breath more easily and reducing the build up of sweat inside the mask.

Some modern fencing masks are now made from clear polymeric material, such as polycarbonate. Where a polycarbonate material is used for the face piece 10 and/or panel 12 (which may be formed integrally with each other) the channel member 16 may be moulded integrally with the face piece 10 or panel 12 or comprise a plastic material extrusion or moulding bonded thereto.

The complete separation of the bib function of protecting the neck and the padding for the fencers face allows much greater choice and variety of design and removability of the interior padding. Also, by making the bib removable from the mask, different colour bibs can be used to indicate different teams. Also the bibs can be made to be asymmetric for left and right handed use.

What is claimed is:

1. A mask for protecting the face and neck of a person while fencing, the mask comprising a mask body, including a face piece for protecting the face of the wearer, retaining means for retaining the mask on the head of a wearer and a neck covering member for protecting the neck of a wearer, the neck covering member being detachably securable to the mask body by means of co-operating interlocking or interconnecting members provided respectively on the neck covering member and on the mask body such that there is provided a continuous join along the interface between the neck covering member and the mask body, whereby when the neck covering member is connected to the mask body, no gaps exist between the neck covering member and the mask body through which the blade of a sword might pass.

2. A mask as claimed in claim 1, wherein the interlocking or interconnecting members comprise an elongate channel member, provided on one of the neck covering member or the mask body, and an elongate bead, provided on the other of the neck covering member or the mask body, the elongate bead being receivable in the channel member to retain the neck covering member on the mask body.

3. A mask as claimed in claim 2, wherein the open side of the channel member has a width which is less than an internal width of the channel member at a position spaced inwardly from said open side such that the elongate bead can be slid into and out of the channel member from an end thereof but the bead cannot be removed from the channel member in a direction normal to the longitudinal axis of the channel.

4. A mask as claimed in claim 3, wherein the channel member comprises two opposed side portions defining a receiving channel having a substantially circular cross section, the outer ends of the side portions defining an open side of the receiving channel, the open side having a width which is less than a diameter of a circle defined by the side portions.

5. A mask as claimed in claim 2, wherein the channel member is provided on the mask body and the elongate bead is provided on or adjacent an upper edge of the neck covering member.

6. A mask as claimed in claim 2, wherein the neck covering member is formed from a flexible fabric material and the elongate bead is defined by an elongate rod enclosed in a sleeve formed along the upper edge of the neck covering member.

7. A mask as claimed in claim 2, wherein the elongate bead comprises a molded or extruded plastic section which is attached to the upper edge of the neck covering member by meant of stitching or adhesive.

8. A mask as claimed in claim 2, wherein the mask body includes a panel extending over the top and sides of the wearers head and under the wearers chin, the channel member being attached to a lower edge of the panel extending from one side of the mask to the other side from positions adjacent the ears of the wearer and passing beneath the chin of the wearer.

9. A mask as claimed in claim 8, wherein the panel and the face piece are formed from a metallic mesh.

10. A mask as claimed in claim 8, wherein at least a portion of the face piece and/or the panel is formed from a transparent polymeric material and the face piece is formed integrally with the panel.

11. A mask as claimed in claim 10, wherein the channel member is formed integrally with the face piece and/or the panel.

12. A mask as claimed in claim 10, wherein the transparent polymeric material is polycarbonate.

13. A mask as claimed in claim 2, wherein the channel member extends along the entire free edge of the panel, at least one gap or open section being provided in the channel member to allow the elongate bead of the neck covering to be enter or exit the channel member so that the neck covering can be replaced.

14. A mask as claimed in claim 2, wherein the retaining means for retaining the mask on the head of a wearer is mounted in the channel member such that the position of the retaining means on the mask can be adjusted by sliding the retaining means along the channel member.

15. A mask as claimed in claim 14, wherein the retaining means comprises a pair of substantially rigid retaining members have a bead portion receivable in the channel member such that the retaining members can be mounted in opposite sides of the mask.

* * * * *